US005975382A

United States Patent [19]

Muroi et al.

[11] Patent Number: 5,975,382

[45] Date of Patent: Nov. 2, 1999

[54] CONTINUOUS CASTING NOZZLE FOR CASTING MOLTEN STEEL

[75] Inventors: Toshiyuki Muroi, Gifu-Ken; Tosikazu Takasu, Tokyo, both of Japan

[73] Assignees: Akechi Ceramics Kabushiki Kaisha, Gifu-ken; Tokyo Yogyo Kabushiki Kaisha, Tokyo, both of Japan

[21] Appl. No.: 09/010,291

[22] Filed: Jan. 21, 1998

[30] Foreign Application Priority Data

Jan. 21, 1997 [JP] Japan ..... 9-023211

[51] Int. Cl.[6] ..... B22D 41/08

[52] U.S. Cl. ..... 222/606; 222/590

[58] Field of Search ..... 222/606, 607, 222/590, 594, 591

[56] References Cited

FOREIGN PATENT DOCUMENTS 5-309457 11/1993 Japan .

OTHER PUBLICATIONS

"Prevention of Alumina Buildup in Submerged Entry Nozzle for Continuous Casting of Steel" by Hiroshi Kyoden, Yasutoshi Namba and Eishi Iida, Shinagawa Technical Report, vol. 31, Dec. 1988, pp. 85–96.

Japanese Abstract JP408215811A of Japanese Application No: JP 07056454, Aug. 1996.

*Primary Examiner*—Scott Kastler
*Attorney, Agent, or Firm*—Thorp Reed & Armstrong, LLP

[57] ABSTRACT

The invention is related to a continuous casting nozzle for casting of aluminum killed steel without clogging of the bore of the nozzle. The surface layer of the bore of the continuous casting nozzle contacting with the molten steel is composed of a refractory comprising graphite from 10 to 35 wt %, a neutral or basic aggregate from 30 to 50 wt % such as $Al_2O_3$ and pottery stone as the remaining part of the refractory.

7 Claims, 1 Drawing Sheet

CONTINUOUS CASTING NOZZLE FOR CASTING MOLTEN STEEL

BACKGROUND OF THE INVENTION

1. Field of the Invention

The present invention relates to a continuous casting nozzle for permitting effective prevention of narrowing or clogging of the nozzle bore through which molten steel passes from tundish to mold while performing continuous casting of molten steel containing aluminum such as aluminum-killed steel.

2. Description of the Related Art

A continuous casting nozzle for casting molten steel is used for the following purposes. A continuous casting nozzle, which is a means for feeding molten steel from a tundish to a mold, is used for the purpose of preventing the molten steel from being oxidized when contacting the open air and from splashing when the molten steel is poured from a tundish to a mold, and for the purpose of rectifying the flow of the molten steel poured for preventing non-metallic inclusion and slag present near or on the mold surface from being entrapped in the cast steel strand.

Material of a conventional continuous casting nozzle for casting molten steel comprises such material as graphite, alumina, silica, silicon carbide and recently zirconia. However, there are following problems in the case of casting aluminum-killed steel and the like.

As for the aluminum-killed steel and the like, aluminum, which is added as a de-oxidizer to molten steel, reacts with oxygen existing in the molten steel to produce non-metallic inclusion such as alpha-alumina. Therefore, in casting the aluminum-killed steel and the like, the non-metallic inclusion such as alpha-alumina adheres and accumulates onto the surface of the bore of the continuous casting nozzle, so that the bore is narrowed or clogged in the worst case, which makes stable casting difficult. Furthermore, the non-metallic inclusion such as alpha-alumnina, adhered or accumulated onto the surface of the bore, peels off or falls down, and is entrapped in the cast steel strand, thus degrading the quality of the cast steel strand.

For the purpose of preventing the above-mentioned narrowing or clogging of the bore caused by the non-metallic inclusion such as alpha-alumina, there is a commonly used method for preventing the non-metallic inclusion such as alpha-alumina existing in the molten steel from adhering or accumulating on the surface of the bore of the nozzle by ejecting inert gas from the inner surface of the nozzle bore toward the molten steel flowing through the bore. An example of this method is described in Japanese Patent Publication No. Hei 6-59533/1994. However, the following for the above-mentioned method wherein inert gas is ejected from the inner surface of the nozzle.

A large amount of the ejected inert gas causes entrapment of bubbles produced by the inert gas in the cast steel strand, resulting in defects based on pinholes. On the other hand, a small amount of the ejected inert gas causes adhesion and accumulation of the non-metallic inclusion such as alpha-alumina onto the surface of the bore of the nozzle, thus causing narrowing or clogging, in the worst case, of the bore.

Additionally, it is constructionally difficult to uniformly eject the inert gas from the inner surface of the nozzle bore toward the molten steel flowing through the bore. Also, in the case that the casting is performed over a long period of time, a stable control of the amount of ejected inert gas becomes gradually more difficult as the composition and the structure of the material consisting of the continuous casting nozzle degrades. Moreover, it becomes difficult to eject inert gas uniformly from the inner surface to the nozzle bore. As a result, the non-metallic inclusion such as alpha-alumina adheres and accumulates onto the surface of the bore of the nozzle so that the bore is narrowed or clogged at the end.

It is thought that the clogging of the nozzle by the non-metallic inclusion, especially by the alumina inclusion, is caused as described below.

(1) Alumina inclusion is produced from aluminum in the steel by secondary oxidation, such as oxidation by entrapped air passing through a refractory junction and refractory structure.

(2) In addition, silica contained in conventional alumina-graphite material of a nozzle reacts with the graphite to produce silicon-monoxide(SiO), which oxidizes aluminum in steel to produce alumina.

(3) Alumina inclusion is produced by diffusion and cohesion of the alumina particles produced in the above process.

(4) Graphite on the surface of the nozzle bore vanishes and the surface of the bore becomes rough thus, the alumina inclusion is apt to accumulate on the rough surface of the bore.

On the other hand, as a counterplan in view of nozzle material, a alumina-graphite nozzle containing a non-oxide raw material (SiC, $Si_3N_4$, BN, $ZrB_2$, SIALON, etc.) that has low reactivity with aluminum oxide, or a nozzle consisting of the non-oxide material itself is proposed. An example of this type of counterplan is described in Japanese Patent Publication No. Sho 61-38152/1986. However, this counterplan is not practical in the case of the alumina-graphite nozzle because the adhesion preventing effect is not recognized and further corrosion resistance is decreased unless much of the non-oxide material is added.

Also, a nozzle consisting of only the non-oxide material is not suitable for practical use in view of material cost and manufacturing cost, although a substantial effect is expected.

A nozzle consisting of graphite-oxide raw material containing CaO has been proposed. A low-melting-point material is produced by a reaction of CaO in the oxide raw material containing CaO ($CaO.ZrO_2$, $CaO.S_iO_2$, $2CaO.S_iO_2$ etc.) with $Al_2O_3$, which is easily separated from the steel. An example of this is described in Japanese Patent Laid-Open Publication No. Sho 62-56101/1987.

However, the reactivity of CaO with $Al_2O_3$ is apt to be influenced by a temperature condition of the molten steel in casting, and there is a case in which the amount of CaO is not sufficiently secured for satisfying spalling resistance and corrosion resistance when high levels of $Al_2O_3$ inclusion is contained in the steel.

SUMMARY OF THE INVENTION

The object of the present invention is to provide a continuous casting nozzle having the following features. The nozzle of the present invention forms a glass layer at the surface of the bore of the nozzle when the nozzle is used, thereby preventing air from being entrapped through refractory structure, smoothing the bore surface of the nozzle and preventing the accumulation of alumina. Also, the present invention provides a continuous casting nozzle which prevents erosion by products having a low-melting produced by a reaction between the aggregate in a refractory and alumina in the steel. The present invention also provides a nozzle which is not influenced by a temperature of the molten steel in casting, and which is able to prevent the bore from narrowing or clogging economically, comparatively easy and stable. Thus, the nozzle of the present invention eliminates the gas injection into the nozzle bore.

In the first embodiment of the present invention, the surface layer of the bore of a continuous casting nozzle contacting molten steel is formed of a refractory comprising graphite from 10 to 35 wt %, a neutral or a basic aggregate from 30 to 50 wt % and pottery stone containing sericite ($K_2O.3Al_2O_3.6SiO_2.2H_2O$) as the main component of the remaining part of the above mentioned refractory.

In another embodiment of the present invention, the surface layer of the bore of a continuous casting nozzle contacting molten steel is formed of a refractory comprising graphite from 10 to 35 wt %, a neutral or a basic aggregate from 30 to 50 wt % and pottery stone containing sericite ($K_2O.3Al_2O_3.6SiO_2.2H_2O$) as the remaining part of the above mentioned refractory, wherein the refractory has binder added thereto and is kneaded, formed, and sintered in the anti-oxidizing atmosphere. As for a neutral or a basic aggregate, one or more than one component from the group of $Al_2O_3$ , $ZrO_2$, or MgO can be selected. It is preferable that the pottery stone containing the sericite as the main component is calcinated at a temperature equal to or greater than 800° C. so as to vanish crystal water and to contain alkaline component from 1 to 5 wt %. As for the pottery stone having the above mentioned component, it is preferable that a mixing weight ratio of pottery stone with an average grain diameter equal to or less than 250 $\mu$m is equal to or less than 60% relative to the whole of the pottery stone content. As for the binder, a thermosetting resin, for example, phenol resin is preferred. With respect to forming process of the refractory to the nozzle, cold isostatic pressing (CIP) is preferred.

DETAILED DESCRIPTION OF THE PRESENT PREFERRED EMBODIMENTS OF THE INVENTION

Figure 1:
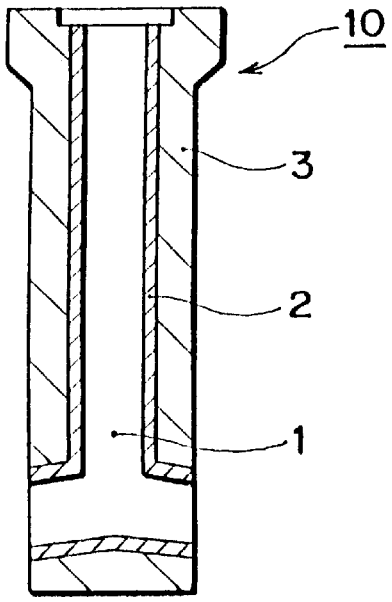
FIG. 1 shows a longitudinal cross section of a nozzle according to the present invention provided with the surface layer of the bore of the nozzle composed of the refractory of the present invention.

A major characteristic of a continuous casting nozzle of the present invention is that the main component of the refractory of the surface layer of the bore of the nozzle is pottery stone. During usage, when silica in the above mentioned refractory coexists with graphite or carbon, the following reactions usually occur.

$$SiO_2(S)+C(S)=SiO(g)+CO(g)$$

$$3SiO(g)+2Al=Al_2O_3(S)+3Si$$

$$3CO(g)+2Al=Al_2O_3(S)+3C$$

As shown in the above reactions, decomposition of the silica produces SiO(g) and CO(g), which react with aluminum in the steel to form $Al_2O_3$ and it becomes the source of oxygen to the steel. However, as for the pottery stone, the pottery stone particles do not decompose but are stable even if it coexists with graphite, namely $SiO_2$ in sericite ($K_2O.3Al_2O_3.6SiO_2.2H_2O$), which is the main mineral of the pottery stone. This fact was evident from an experiment which verified that the particles do not decay and bubbles are not produced, which was confirmed by means of a microscope observation, in a briquette consisting of the pottery stone, resin powders and carbon powders that underwent a heat-treatment at a temperature of 1500° C. for 24 hours while burying it in a coke breeze.

The half-melting temperature of the pottery stone is about 1400° C, so that it melts at the bore surface which contacts the molten steel to form a glass coat for smoothing the structure of the surface of the bore and for preventing air from being entrapped through the refractory structure. This is evidenced from the fact that the permeability is decreased such that the permeability after performing heat-treatment at a temperature of 1500° C. for 1 hour is as small as about $9.5\times\mathbf{10}^{-5}$ darcy, in contrast to the permeability after performing heat-treatment at a temperature of 1000° C. for 1 hour at about $9.5\times10^{-4}$ darcy.

As for types of pottery stone, it is possible to use the following types of pottery stone: sericite matter pottery stone, kaolin matter pottery stone, feldspar matter pottery stone and pyrophyllite matter pottery stone. The sericite matter pottery stone with refractoriness from SK20 to SK27 where SK(Seger cone) is a Japanese Standard for refractoriness is suitable, considering formation of a glass layer and erosion resistance against the molten steel, as the surface of the bore contacting the molten steel is half-molten when used. Although the mixing amount of the pottery stone is the remaining part of the mixing amount of the other components, a mixing weight ratio of the pottery stone is preferably equal to or greater than 30 wt % to actively form the glass coat on the surface of the bore in use as the continuous casting nozzle. Also, it is preferably that the mixing weight ratio of the pottery stone is equal to or less than 60 wt % because the degree of softening deformation is large when in the range of greater than 60 wt %. Therefore, the preferred mixing weight ratio of the pottery stone is from 30 wt % to 60 wt %. In this case, the aggregate of pottery stone particles does not decompose even when coexisting with graphite.

The reason for preferably using the pottery stone calcinated at a temperature equal to or greater than 800° C. is to vanish crystal water so that the crystal water is released from the pottery stone at a temperature in a range of from 500° to 800° C. in calcination and the refractory cracks are caused by virtue of an unusually large coefficient of thermal expansion in this range. The alkaline component of the pottery stone from 1 to 5 wt % is preferred to control the melting point of pottery stone adequately.

It is preferable that a mixing weight ratio of pottery stone with an average grain diameter equal to or less than 250 $\mu$m is equal to or less than 60% relative to the whole of the pottery stone content, because in the range of greater than 60%, structural defects such as lamination are apt to be produced in molding and the softening deformation of pottery stone particles is apt to happen when used in a continuous casting nozzle. As for the neutral or basic aggregate to be mixed, one or more than one component from the group of $Al_2O_3$, $ZrO_2$, or MgO can be selected thus, enhancing the corrosion resistance of the nozzle.

With regard to graphite, to prevent the softening deformation and to maintain heat-impact resistance of the pottery stone a mixing weight ratio of the graphite is preferably equal to or greater than 10 wt %. Also, it is preferably that the mixing weight ratio of the graphite is equal to or less than 35 wt % from the view point of manufacturing the nozzle. If the volume ratio of the graphite relative to the pottery stone is too large, structural defects such as lamination are apt to be produced in the range of greater than 35 wt %. Considering thermal conductivity and oxidation resistance, natural graphite is suitable as the graphite to be mixed. And the most preferable process of mixed material to nozzle shape is CIP(cold isostatic pressing) to produce the nozzle having a high heat resistance.

As for the binder for forming the nozzle body a thermosetting resin phenol resin or epoxy resin, for example, is preferably used and the mixing ratio is preferably 5 to 15 wt % of the mixed material.

Sintering of the formed body is preferably performed in a nonoxidizing atmosphere to minimize the burning loss of the graphite mixed in the material. The graphite is mixed to enhance the erosion resistance and oxidation resistance and the sintering temperature is preferably 1000° to 1200° C. to obtain a sufficient strength for the nozzle.

The continuous casting nozzle for steel according to the present invention will be described in detail with reference to the accompanying drawings of the nozzle for continuous casting. As shown in FIG. 1, a surface layer 2 of the bore 1 of the immersion nozzle 10, through which the molten steel flows, consists of a refractory having the chemical composition as described above. The remaining part of the nozzle 3 is composed of regular refractory, for example, of a conventional alumina-graphite. The dimensions of the nozzle are about 1,000 mm in total length, about 60 mm in bore diameter, 160 mm in outer diameter, and about 50 mm in thickness.

Figure 2:
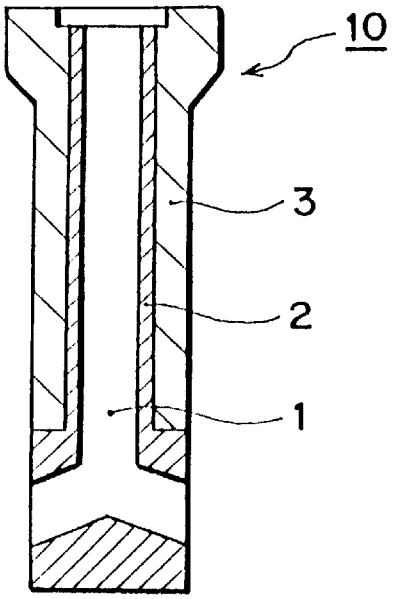
FIG. 2 shows a longitudinal cross section of a nozzle according to the present invention provided with the surface layer of the bore of the nozzle and the lower part of the nozzle which is immersed in the molten steel being both composed of the refractory of the present invention.

FIG. 2 shows another embodiment of the invention which is a nozzle 10 comprising a refractory according to the present invention at the surface layer of the bore 1 of the nozzle 10 and the lower part of the nozzle which is immersed in molten steel. In the bore 1 of the nozzle 10 for continuous casting, the adherence and accumulation of non-metallic inclusion such as the alpha-alumina are decreased.

EXAMPLES

The present invention is explained with examples as described below. The samples Nos. 1 to 5 (hereinafter referred to as the "sample of the present invention") have the chemical composition within the scope of the present invention, and the samples Nos. 6 to 8 (hereinafter referred to as "sample for comparison") have chemical composition out of the scope of the present invention were prepared as shown in Table 1, and phenolic resin in the state of powder and liquid were added in an amount within a range of from 5 to 10 wt % to each of the mixed materials. From the mixed materials above, the following formed bodies were prepared. A first formed body (hereinafter referred to as the "formed body 1") with dimensions of 30 mm by 30 mm by 230 mm was prepared for examining an amount of adhesion of non-metallic inclusion such as alumina and corrosion resistance against the molten steel. A second formed body (hereinafter referred to as the "formed body 2") was prepared with dimensions of 50 mm in diameter by 20 mm for examining permeability, and a third formed body (hereinafter referred to as the "formed body 3") was prepared with dimensions of 100 mm in outer diameter, 60 mm in inner diameter and 250 mm in length for examining spalling resistance and then the three bodies were sintered in reduced atmosphere at a temperature in a range from 1000° to 1200° C. and the samples 1 to 8 were prepared.

Physical properties (porosity and bulk density) for each of the above-mentioned samples of the present invention Nos. 1 to 5 and the samples for comparison Nos. 6 to 8 are shown in Table 1. The spalling resistance of each of the sintered formed bodies 3 of the samples of the present invention Nos. 1 to 5. and the samples for comparison Nos. 6 to 8 were examined after heating at a temperature of 1500° C. for 80 minutes in an electric furnace and then rapidly cooling in water. The results are shown in Table 1. An erosion ratio (%) and an amount of adhesion of non-metallic inclusion such as alumina onto the sintered formed bodies 1 of the samples of the present invention Nos. 1 to 5 and the samples for comparison Nos. 6 to 8 were examined after immersing in molten steel, which contains aluminum in a range from 0.02 to 0.05 wt % at a temperature of 1550° C. for 180 minutes. The results are shown in Table 1. The permeability for each of the sintered formed bodies 2 of the samples of the present invention Nos. 1 to 5 and the samples for comparison Nos. 6 to 8 were examined after heating at a temperature of 1500° C. for 60 minutes in an electric furnace and then cooling. The results are shown in Table 1.

It is easily understood from Table 1 that the samples of the present invention are superior in the spalling resistance. Also, the non-metallic inclusion such as alumina does not adhere in spite of the low erosion ration, thereby effectively preventing narrowing or clogging of the continuous casting nozzle of the molten steel. Also, the samples of the present invention prevented air from being entrapped through the refractory when in practical use because of small permeability. On the other hand, it is obvious that the sample for comparison No. 6 is remarkably inferior in the spalling resistance and the corrosion resistance against the molten steel, although a small amount of alumina adhered due to much pottery stone content. As for the sample for comparison No. 7, the amount of adhesion of alumina is remarkably large, because it contains $Al_2O_3$ and $SiO_2$, which decomposes to supply oxygen in the steel, instead of the pottery stone. As for the sample for comparison No. 8, it does not contain $SiO_2$ and contains only $Al_2O_3$ instead of pottery stone. It has a high permeability and the amount of adhesion of alumina is remarkably large although it contains no mineral source of oxygen to the steel. Therefore, with the use of the continuous casting nozzle for casting steel according to the present invention, it is possible to perform stable casting while preventing narrowing or clogging of the bore caused by the non-metallic inclusion such as alumina without deterioration of the refractory structure. According to the present invention, 5 to 7 charges of approximately 300 ton of low carbon aluminum killed steel is continuously cast with one nozzle without clogging by 2 strand slab caster in real operation, though, with conventional nozzle, clogging up of one nozzle occurred within 2 to 4 charges under the same conditions.

TABLE 1

| | | Sample No. of the Present Invention | | | | | Sample No. for Comparison | | |
|---|---|---|---|---|---|---|---|---|---|
| | | 1 | 2 | 3 | 4 | 5 | 6 | 7 | 8 |
| Mixing Composition (wt %) | Graphite | 10 | 15 | 25 | 30 | 35 | 5 | 25 | 25 |
| | Pottery stone (0.5–1 mm) | 25 | 25 | 20 | 15 | 15 | 25 | — | — |
| | Pottery stone (−0.25 mm) | 35 | 30 | 25 | 15 | 15 | 40 | — | — |
| | $Al_2O_3$ | 30 | 30 | 30 | 40 | 35 | 30 | 50 | 70 |
| | $SiO_2$ | | | | | | | 25 | |
| Physical Properties | Porosity (%) | 11.6 | 12.1 | 12.5 | 13.4 | 13.5 | 11.5 | 12.8 | 16.4 |
| | Bulk density | 2.12 | 2.13 | 2.15 | 2.18 | 2.16 | 2.20 | 2.30 | 2.56 |
| | Modulus of Rupture (MPa) | 7.6 | 8.1 | 8.5 | 8.0 | 7.5 | 8.0 | 12.1 | 8.0 |
| | Erosion to Molten Steel | 10 | 8 | 7 | 4 | 5 | 35 | 3 | 1 |
| | Permeability ($\times 10^{-5}$ darcy) | 3.5 | 5.1 | 6.5 | 8.5 | 9.0 | 3.0 | 6.5 | 9.5 |
| | After Heat-treatment 1500° C.-1 hr | | | | | | | | |
| | Spalling Resistance | No Crack | No Crack | No Crack | No Crack | No Crack | Crack Occurrence | No Crack | Crack Occurrence |
| | Amount of Adhesion of Alumina | Approx. 1 | Approx. 0 | Approx. 0 | Approx. 0 | Approx. 1.0 | 5 | 3 | 10 |

We claim:

1. A continuous casting nozzle, wherein the surface layer of a bore of said continuous casting nozzle contacting the molten steel is formed of a refractory comprising:

(a) graphite from 10 to 35 wt %;

(b) a neutral or a basic aggregate from 30 to 50 wt %; and (c) pottery stone from 30 to 60 wt % containing sericite ($K_2O.3Al_2O_3.6Si.O_2.2H_2O$) as the main component.

2. A continuous casting nozzle, wherein the surface layer of a bore of said continuous casting nozzle contacting the molten steel is formed of a refractory comprising:

(a) graphite from 10 to 35 wt %;

(b) one of a neutral and a basic aggregate from 30 to 50 wt %; and (c) pottery stone from 30 to 60 wt % containing sericite ($K_2O.3Al_2O_3.6SiO_2.2H_2O$) as the main component, said refractory being added binder, said refractory being kneaded, formed to said nozzle, and sintered in a non-oxidizing atmosphere.

3. A continuous casting nozzle according to claim 2, wherein said aggregate is at least one component selected from the group consisting of $Al_2O_3$, $ZrO_2$, and MgO.

4. A continuous casting nozzle according to claim 2, wherein the pottery stone containing the sericite as the main component, is calcinated at a temperature equal to or greater more than 800° C. so as to vanish crystal water and contains alkaline component from 1 to 5 wt %.

5. A continuous casting nozzle according to claim 2, wherein a mixing weight ratio of the pottery stone, whose average grain diameter is equal to or less than 250 $\mu$mm is equal to or less than 60% relative to the whole of the pottery stone content.

6. A continuous casting nozzle according to claim 2, wherein said binder is a thermosetting resin.

7. A method comprising forming a refractory to a continuous casting nozzle through cold isostatic pressing whereby the surface layer of a bore of the continuous casting nozzle contacting the molten steel is formed of the refractory, and the refractory is comprised of graphite from 10 to 35 wt %, a neutral or a basic aggregate from 30 to 50 wt %, and pottery stone from 30 to 60 wt % containing sericite ($K_2O.3Al_2O_3.6Si.O_2.2H_2O$) as the main component.

* * * * *